United States Patent [19]

Linton

[11] Patent Number: 4,545,202

[45] Date of Patent: Oct. 8, 1985

[54] PRESSURE-REGULATING SYSTEM

[75] Inventor: David J. Linton, Rockford, Ill.

[73] Assignee: Sundstrand Corporation, Rockford, Ill.

[21] Appl. No.: 545,043

[22] Filed: Oct. 24, 1983

[51] Int. Cl.[4] ..... F15B 18/00

[52] U.S. Cl. ..... 60/420; 60/425; 60/426; 74/687

[58] Field of Search ..... 91/517, 519, 530, 511, 91/513, 518, 516, 532; 137/115, 596.12; 74/665 A, 665 B, 665 E, 687; 60/420, 421, 425, 426

[56] References Cited

U.S. PATENT DOCUMENTS

| | | | |
|---|---|---|---|
| 1,034,242 | 7/1912 | Johnson | 74/665 B |
| 2,985,243 | 5/1961 | Tyler et al. | 170/135.72 |
| 3,154,925 | 11/1964 | De Vita | 91/517 X |
| 3,416,311 | 12/1968 | Yoshizawa | 60/53 |
| 3,643,922 | 2/1972 | Van Der Linde | 60/426 X |
| 3,662,550 | 5/1972 | Lichtfuss | 60/53 R |
| 3,695,783 | 10/1972 | Soyland et al. | 417/216 |
| 3,716,308 | 2/1973 | Kobald | 417/286 |
| 3,720,059 | 3/1973 | Schurawski et al. | 60/421 |
| 3,723,026 | 3/1973 | Soyland et al. | 417/286 |
| 3,767,327 | 10/1973 | Wagenseil | 417/216 |
| 3,768,928 | 10/1973 | Miller et al. | 417/213 |
| 3,820,257 | 6/1974 | Junck et al. | 91/519 X |
| 3,868,821 | 3/1975 | Ratliff et al. | 60/421 |
| 3,910,044 | 10/1975 | Symmank | 60/420 |
| 3,998,053 | 12/1976 | Johnson | 60/422 |
| 4,089,166 | 5/1978 | Ratliff et al. | 60/426 X |

*Primary Examiner*—Robert E. Garrett
*Assistant Examiner*—John M. Husar
*Attorney, Agent, or Firm*—Wood, Dalton, Phillips, Mason & Rowe

[57] ABSTRACT

A system for limiting the torque of a multiple hydraulic system power drive unit wherein plural hydraulic motors are connected to a common torque-summing output device. The system has at least two separate hydraulic circuits, with there being a pressure-limiting valve in each circuit which controls the porting of motor pressure to a low pressure return line and which sums the motor pressure existing in the fluid circuit in which the valve is positioned and the pressure in the other hydraulic circuit whereby the maximum pressure of the fluid delivered to the motor cannot exceed one-half the maximum pressure when both circuits are active to limit the torque applied to the torque-summing output device. In a system having two separate hydraulic circuits, the pressure-limiting valve has a first pressure-responsive area exposed to motor pressure in one circuit and a second pressure-responsive area exposed to pressure in the other circuit, with the latter pressure-responsive area being one-half the first pressure-responsive area.

11 Claims, 1 Drawing Figure

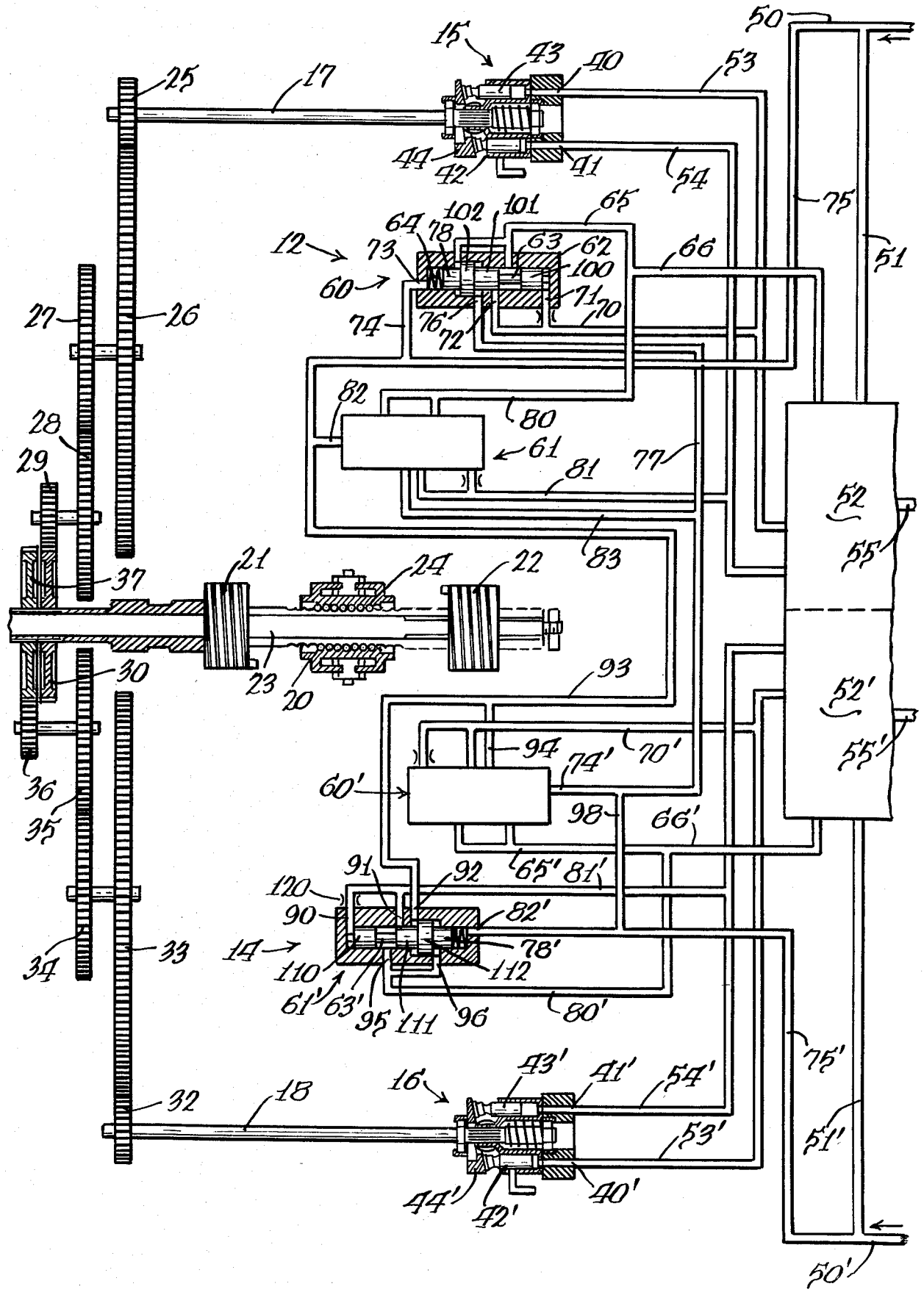
50
15
43
40
53
25
17
44
42
41
54
75
51
64
102
101
65
78
63
62
12
73
66
100
60
71
70
27
26
74
76
72
82
80
28
61
29
81
77
52
55
37
21
24
22
83
23
20
30
93
52'
55'
94
74'
70'
36
60'
98
66'
35
91
92
65'
81'
120
90
82'
78'
34
33
14
110
112
61'
63'
95
111
96
80'
75'
43'
41'
54'
16
32
18
53'
51'
44'
42'
40'
50'

PRESSURE-REGULATING SYSTEM

TECHNICAL FIELD

This invention pertains to a pressure-regulating system for plural hydraulic motors in separate hydraulic circuits which have their drive outputs connected to a common torque-summing output and with at least minimum torque provided when only one hydraulic circuit is pressurized and maximum torque not exceeded when more than one hydraulic circuit is pressurized.

More particularly, the pressure-regulating system is used in a hydraulic power drive unit fed by two independent hydraulic systems, each having a motor connected to a common torque-summing gearbox and with the pressure-regulating system assuring that there will be a maximum torque level which does not exceed the maximum torque level of a single motor.

The power drive unit can be used in aircraft surface drive systems where redundant hydraulic systems are provided in the event one system fails.

BACKGROUND ART

It is known in the art to sense and sum pressures in plural hydraulic circuits and resultingly control displacement of pumps in the circuits or the discharge flow of pressurized fluid within the circuits. However, the prior art does not disclose a torque-limiting system having plural hydraulic circuits wherein the fluid in the circuits is not mixed and with the motors of the hydraulic circuits having their outputs mechanically summed in a common torque-summing output device with the maximum torque not being exceeded regardless of whether two or more hydraulic circuits, each having a motor connected to the torque-summing device, have their circuits pressurized.

DISCLOSURE OF THE INVENTION

A primary feature of the invention is to provide a system for limiting the torque of a multiple hydraulic system power drive unit wherein a pair of hydraulic motors in separate circuits have their drive outputs connected to a torque-summing unit and with each circuit having a valve for porting excessive pressure in the circuit to a lower pressure level when the other hydraulic circuit is pressurized, whereby either motor can provide the necessary power for the power drive unit and the maximum torque output of the two motors will not be applied to the torque-summing unit. This avoids the necessity of overbuilding the output mechanism to handle the maximum torque output of both motors.

Another feature of the invention is to provide a pressure-limiting valve for use in a hydraulic circuit having a motor connected to a torque-summing output device which is also driven by another motor in a separate hydraulic circuit, with there being a pressure-limiting valve in each of said circuits which senses that the other hydraulic circuit is pressurized and operates to control the delivery of either full pressure to the motor in the same circuit when the other circuit is not active or half of full pressure to the motor in the same circuit when the other circuit is active whereby the maximum torque that can be applied to the torque-summing output device is equal to that which can be applied by a single motor.

An object of the invention is to provide a pressure-regulating system for plural hydraulic motors which are in separate hydraulic circuits each having a fluid supply line and which have their drive outputs connected to a common torque-summing output and with minimum torque provided when only one hydraulic circuit is pressurized and maximum torque not exceeded when more than one hydraulic circuit is pressurized comprising: a plurality of pressure-limiting valves with there being one of said valves in each of said hydraulic circuits, each of said valves having means including a valve member operable to control the porting of fluid from a high pressure motor line for the motor to a lower pressure return line; means associated with each valve member having a pressure-responsive area for sensing the pressure in the high pressure motor line of the hydraulic circuit in which the pressure-limiting valve is connected; and means associated with each valve member for individually sensing the pressure in the fluid supply lines of the other hydraulic circuits to provide a force acting on the valve member to open the high pressure motor line to the lower pressure return line, said last-mentioned means comprising pressure-responsive areas which are fractionally less in area than the first-mentioned pressure-responsive area.

Still another object of the invention is to provide a pressure-regulating system as defined in the preceding paragraph wherein there are two of said hydraulic circuits and the area of said first-mentioned pressure-responsive area is twice that of the pressure-responsive area of the last-mentioned means.

A further object of the invention is to provide a pressure-regulating system as defined in the preceding paragraphs, wherein there can be more than two hydraulic circuits, each having a motor and the pressure-responsive area of each valve member for individually sensing the pressure in the fluid supply lines of the other hydraulic circuits have an area which is 1/M of the first-mentioned pressure-responsive area and with M equalling the total number of motors in said separate hydraulic circuits.

BRIEF DESCRIPTION OF THE DRAWING

The FIGURE is a schematic of the hydraulic power drive unit having the pressure-regulating system with parts broken away.

BEST MODE FOR CARRYING OUT THE INVENTION

A pair of separate hydraulic circuits, indicated generally at 12 and 14, each have a fluid motor 15 and 16, respectively, with output shafts 17 and 18 connected to a mechanical torque-summing unit having an output mechanism which is shown, for example, as a ball nut 20. The ball nut 20 is movable between a pair of limit stops 21 and 22 by rotation of a drive shaft 23 having a spiral external groove. A series of balls 24 are positioned in the spiral external groove of the drive shaft and an internal spiral groove within the ball nut. With the ball nut held against rotation, rotation of the drive shaft 23 causes linear movement of the ball nut. The drive to the drive shaft 23 from the motor output shafts 17 and 18 is through a torque-summing gearbox. The motor output shaft 17 mounts a gear 25 meshing with a gear 26 fixed to a gear 27 for rotation about an offset axis and which meshes with a gear 28 mounted for rotation on a separate axis and fixed to a gear 29 which meshes with a gear 30 on the drive shaft 23. The motor output shaft 18 similarly connects to the drive shaft 23 by means of gearing including a gear 32 on the motor output shaft which meshes with a gear 33 fixed to a gear 34 which meshes with a gear 35 which is fixed to a gear 36 meshing with a gear 37 on the drive shaft 23.

Each of the separate hydraulic circuits 12 and 14 is constructed of the same components which are similarly hydraulically connected. The hydraulic motor 15 of the hydraulic circuit 12 is shown as an axial piston, fixed displacement motor which is of conventional construction and which has a pair of ports 40 and 41 which communicate with chambers in a rotatable barrel 42 connected to the motor output shaft 17 and which each have a piston 43 reacting against a fixed cam plate 44. The motor 16 of the hydraulic circuit 14 is of the same construction and similar parts have been given the same reference numeral with a prime affixed thereto.

The motors 15 and 16 are reversible for bidirectional rotation of the motor output shaft 17, depending upon the connection of the motor ports 40 and 41 to a high fluid pressure motor line and a fluid return line at lower pressure.

The hydraulic circuit 12 is supplied with fluid at supply pressure through a fluid line 50, with a branch fluid line 51 delivering fluid under supply pressure to a section 52 of a control valve. The control valve section 52 controls the communication of high pressure fluid with one or the other of a pair of fluid lines 53 and 54 extending from the control valve section 52 to the motor ports 40 and 41, respectively. The fluid line 53 or 54 which is not connected to supply pressure is connected to a return line 55 extending from the control valve section. The same components and connections exist in the separate hydraulic circuit 14 and with these components being given the same reference numeral with a prime affixed thereto.

The hydraulic circuit 12 has a pair of pressure-limiting valves, indicated generally at 60 and 61 which are alternately operable, depending upon the direction of rotation of the fluid motor 15 and, therefore, which of the fluid lines 53 and 54 has high fluid pressure.

Referring particularly to the pressure-limiting valve 60, a valve body 62 has a bore in which a valve member 63 is movable and which is urged toward the right, as viewed in the Figure, by a spring 64. The valve body 62 has a pair of ports connected to a fluid line 65 which, by means of a connecting fluid line 66, extends to the control valve section 52 and communicates with the return line 55. The fluid line 53 extending from the control valve section 52 to the motor port 40 communicates with a fluid line 70 having a pair of branches connecting with a pair of ports 71 and 72 in the valve body. The port 71 communicates with an end of the valve bore and the port 72 communicates with an intermediate section of the valve bore. A port 73, at an end of the valve body, communicates an end of the bore with a line 74 connected to a fluid line 75 whereby fluid from the high pressure supply line 50 is applied against an end 78 of the valve member 63. An additional port 76 connects to a fluid line 77.

The pressure limiting valve 61 has a pair of ports connected to the return line by a fluid line 80 which connects with the fluid line 66. There is also a pair of ports, similar to the ports 71 and 72 of the pressure-limiting valve 60, which communicate through a fluid line 81 with the fluid line 54 extending to the motor port 41. Supply pressure existing in line 50 is applied to an end of the valve member of the pressure-limiting valve 61 through an extension of the fluid line 75 which connects with the pressure-limiting valve 61 at 82. An additional port of the pressure-limiting valve 61 comparable to port 76 of the pressure-limiting valve 12 communicates with the fluid line 77 through a line 83.

The hydraulic circuit 14 has pressure-limiting valves of the same construction, as identified at 60' and 61', and with the connections thereof to the control valve section 52' and the supply line 50' being identified with the same reference numerals with a prime affixed thereto.

For clarity and subsequent description of operation, separate reference numerals have been applied to the ports of the pressure-limiting valve 61'. The ports 90 and 91 which communicate with the fluid line 81' extend to an end and intermediate section of the valve bore, respectively. A port 92 communicates with a fluid line 93 which is an extension of the fluid line 75 and the fluid line 93 has a branch 94 communicating with the pressure-limiting valve 60' and which communicates with a port comparable to port 76 of pressure-limiting valve 60. Ports 95 and 96 communicate with a fluid line 80' which extends to the return line at the control valve section 52' through the fluid line 66'. The supply fluid line 75' communicates with the fluid line 77 through a connecting fluid line 98.

The operation of the hydraulic power drive unit can now be described in conjunction with specific structure of the pressure-limiting valve member.

First, assuming that only the fluid motor 15 is operating with high pressure fluid supplied through fluid line 50 to the control valve section 52, the valve can be positioned to direct fluid at a selected high pressure through the line 53 to the motor port 40 to cause rotation of the motor which, through the gear train, drives the nut of the ball screw. The motor pressure is directed to the pressure-limiter valve 60 through the fluid line 70, with the pressure being applied through the port 71 to a first pressure-responsive area established by the valve land 100. Supply pressure at port 73 acts on the opposite end 78 of the valve member. With the valve member 63 positioned as shown in the Figure, a valve land 101 blocks the port 72 from the low pressure return fluid line 65. The pressure in fluid line 53, acting on the pressure-responsive area 100, cannot exceed the force of the spring 64 and supply pressure, and the valve member 63 remains in the position shown and supply pressure and motor pressure are equal.

When the second separate hydraulic circuit 14 is activated, the high pressure fluid in the fluid supply line 50' is directed to the port 76 of the pressure limiter valve 60 through fluid lines 75', 98 and 77. This fluid pressure acts on a second pressure-responsive area of the valve member 63 defined by a land 102 which has a pressure-responsive area which is one-half the pressure-responsive area of the valve land 100. This, then, reduces by one-half the fluid pressure that may operate the fluid motor 15 because the force created by the pressure acting on the valve land 102 reduces by one-half the pressure in the motor fluid line that can exist before the valve member is shifted to connect the motor line to the return line.

Although this operation has been described with the two circuits coming into operation sequentially, it will be obvious that the same operation occurs if both circuits become active at the same time.

If the fluid motor 15 is operated in the opposite direction and, therefore, fluid pressure exists in the fluid line 54, the pressure-limiter valve 61 is effective to limit the torque output of the fluid motor, with motor pressure being applied through fluid line 81 to an end of the valve member and with supply pressure from the hydraulic circuit 14 being applied to the second pressure-responsive area through the fluid line 83.

Referring to the hydraulic circuit 14, there is the same operation with the summing effect from supply pressure associated with hydraulic circuit 12. Referring particularly to pressure-limiting valve 61', when there is motor pressure in fluid line 54', this pressure is applied through fluid line 81' to a first pressure-responsive area at the end of a valve land 110 through port 90 and port 91 is subject to communication with the fluid return line 80', depending on the position of a valve land 111. Supply pressure is applied to end 78' of the valve member. Absence of a pressure signal from hydraulic circuit 12 results in motor pressure and supply pressure being equal. When hydraulic circuit 12 is operative and supply pressure exists in supply line 50, this is applied to a valve land 112, comparable to valve land 102, through fluid lines 75 and 93, with the latter communicating with the port 92. This reduces motor pressure of hydraulic circuit 14 to one-half supply pressure. When the fluid motor 16 operates in the opposite direction of rotation, there is motor pressure in the fluid line 53' and pressure-limiting valve 60' is operative, with the motor pressure being applied to the valve member thereof in the same manner through the fluid line 70' and with supply pressure from hydraulic circuit 12 being applied to the valve land thereof comparable to valve land 102 through the branch fluid line 94.

Although the invention has been disclosed in connection with two separate hydraulic circuits, it will be evident that the concepts may be applied to a system having three or more separate hydraulic circuits each having a fluid motor with their outputs connected to a mechanical torque-summing unit. Assuming there are M motors, each in a separate hydraulic circuit, each valve member of the pressure-limiting valve will have multiple pressure-responsive areas, such as multiple valve lands 102. For example, if there are three separate hydraulic circuits, there will be two individual lands comparable to the valve land 102, with each valve land being individually responsive to the supply pressure in another hydraulic circuit. Each of these valve lands has a pressure-responsive area which is 1/M the pressure-responsive area defined by the valve land 100. More particularly, each of these lands will define a pressure-responsive area which is one-third the area of the pressure-responsive area defined by the land 100.

The rate of travel of a valve member of the pressure-limiting valves can be limited by a damping action achieved by metering flow to an end of the valve by use of an orifice, such as shown at 120, for the pressure-limiting valve 61'.

I claim:

1. A pressure-regulating system for plural hydraulic motors which are both connected to a common torque-summing output device comprising: a first fluid circuit for one of said motors including a high pressure supply line and also having a high fluid pressure motor line and a fluid return line, a pressure-limiting valve connected to said high fluid pressure motor line and said return line and having a valve member urged in a direction to block communication therebetween; a second fluid circuit for the other of said motors including a second high pressure supply line and also having a second high fluid pressure motor line and a second fluid return line, and a second pressure-limiting valve connected to said second high fluid pressure motor line and said second return line and having a valve member urged in a direction to block communication therebetween; each of said pressure-limiting valves having a first pressure-responsive area exposed to the pressure existing at a motor inlet port of the motor in the same fluid circuit, a second pressure-responsive area of the same area as the first pressure-responsive area exposed to the pressure in the high pressure supply line in the same fluid circuit to exert a force in opposition to that exerted by the first pressure-responsive area, and a third pressure-responsive area which is one-half the area of the first and second pressure-responsive areas and which is exposed to the pressure existing in the high pressure supply line in the other fluid circuit, the forces created by said pressures acting in a direction to position a valve member to block communication between a fluid pressure motor line and a return line when there is no pressure in the other fluid circuit and to cause the valve member to set the motor line pressure at one-half supply pressure when there is pressure in the other fluid circuit.

2. A pressure-regulating system as defined in claim 1 wherein there are two of said hydraulic circuits and the area of said first and second pressure-responsive areas is twice that of the pressure-responsive area of the last-mentioned means.

3. A pressure-regulating system as defined in claim 1 wherein there are a total of M separate hydraulic circuits and the pressure-responsive areas of said last-mentioned means having an area which is 1/M of the first and second pressure-responsive areas.

4. A pressure-regulating system for plural hydraulic motors which are in separate hydraulic circuits each having a fluid supply line and which have their drive outputs connected to a common torque-summing output and with minimum torque provided when only one hydraulic circuit is pressurized and maximum torque not exceeded when more than one hydraulic circuit is pressurized comprising: a plurality of pressure-limiting valves with there being one of said valves in each of said hydraulic circuits, each of said valves having means including a valve member operable to control the porting of fluid from a high pressure motor line for the motor to a lower pressure return line; means associated with each valve member having a pair of pressure-responsive areas with one area operable to sense the pressure in the high pressure motor line of the hydraulic circuit in which the pressure-limiting valve is connected and the other area sensing pressure in the supply line of the same hydraulic circuit with said areas being equal and the forces created by said pressures acting in opposition to each other; and means associated with each valve member for individually sensing the pressure in the fluid supply lines of the other hydraulic circuits to provide a force acting on the valve member in the same direction as the force created by the pressure in the high pressure motor line to open the high pressure motor line to the lower pressure return line, said last-mentioned means comprising pressure-responsive areas which are fractionally less in area than the first-mentioned pressure-responsive area.

5. A pressure-regulating system for plural separate hydraulic circuits each having a supply line, a high pressure motor line and a lower pressure line and a motor, said motors having their drive outputs connected to a common torque-summing output and with minimum torque provided when only one hydraulic circuit is pressurized and maximum torque not exceeded when more than one hydraulic circuit is pressurized comprising: a plurality of pressure-limiting valves with there being one of said valves in each of said separate hydraulic circuits, each of said valves having a movable valve member operable to control the porting of fluid from the high pressure motor line for the motor to the lower pressure line of the hydraulic circuit, each valve member having a first pressure-responsive area for sensing the pressure in the high pressure motor line of the hydraulic circuit in which the pressure-limiting valve is connected and a second pressure-responsive area for sensing pressure in the supply line with the two areas being substantially equal and the pressures acting on said two areas creating opposing forces; and each valve member having additional pressure-responsive areas equal in number to the total of separate hydraulic circuits minus one for individually sensing the existence of pressure in the other hydraulic circuits, said additional pressure-responsive areas being fractionally less in area than the first and second pressure-responsive areas.

6. A pressure-regulating system as defined in claim 5 wherein there are two of said hydraulic circuits and the area of said first and second pressure-responsive areas is twice that of said additional pressure-responsive area.

7. A pressure-regulating system as defined in claim 5 wherein there are a total of M separate hydraulic circuits and said additional pressure-responsive areas each have an area which is 1/M of the first and second pressure-responsive areas.

8. A pressure-regulating system for two separate hydraulic circuits each having a high pressure motor line and a lower pressure line and a motor, said motors having their drive outputs connected to a common torque-summing output and with maximum torque not exceeded when more than one hydraulic circuit is pressurized comprising: a pair of pressure-limiting valves with there being one of said valves in each of said hydraulic circuits, each of said valves having a movable valve member operable to control the porting of fluid from the high pressure motor line for the motor to the lower pressure line of the hydraulic circuit, each valve member having a first pressure-responsive area for sensing the pressure in the high pressure motor line of the hydraulic circuit in which the pressure-limiting valve is connected and a second pressure-responsive area for sensing pressure in the supply line with the two areas being substantially equal and the pressures acting on said two areas creating opposing forces; and each valve member having an additional pressure-responsive area which is one-half the area of said first and second pressure-responsive areas for sensing the pressure in the other hydraulic circuit.

9. A pressure-regulating system for a total of M hydraulic motors which are connected to a common torque-summing output device comprising: a first fluid circuit for one of said motors including a fluid pressure motor line, a fluid return line, and a supply line, a pressure-limiting valve connected to said fluid pressure motor line and said return line and having a valve member urged in a direction to block communication therebetween; additional fluid circuits one for each of the additional motors with each additional circuit including a second fluid pressure motor line and a second fluid return line, a second pressure-limiting valve connected to said second fluid pressure motor line and said second return line and having a valve member urged in a direction to block communication therebetween; each of said pressure-limiting valves having a first pressure-responsive area exposed to the pressure existing at a motor inlet port of the motor in the same fluid circuit and a second pressure-responsive area for sensing pressure in the supply line with the two areas being substantially equal and the pressures acting on said two areas creating opposing forces and having additional pressure-responsive areas equal in number to said additional fluid circuits exposed to the pressures existing in the other fluid circuits and with each of said additional pressure-responsive areas having an area which is 1/M the area of the first and second pressure-responsive areas, the forces created by said pressures acting in a direction to open communication between a fluid pressure motor line and a return line.

10. In a pressure-regulating system for a pair of hydraulic motors which are in separate hydraulic circuits each having a supply line and which have their drive outputs connected to a common torque-summing output and with minimum torque provided when only one hydraulic circuit is pressurized and maximum torque not exceeded when more than one hydraulic circuit is pressurized, a pressure-limiting valve for use one in each of said hydraulic circuits, said valves having means including a valve member operable to control the porting of fluid from a high pressure motor line for the motor to a lower pressure return line, the pressure-limiting valve having a first pressure-responsive area for sensing the pressure in the high pressure motor line of the hydraulic circuit in which the pressure-limiting valve is connected and a second opposed pressure-responsive area for sensing pressure in the supply line, and means associated with the valve member for individually sensing the pressure in the other hydraulic circuit, said last-mentioned means comprising a pressure-responsive area which is one-half the area of the first and second pressure-responsive areas.

11. A pressure-regulating system for plural hydraulic motors which are both connected to a common torque-summing output device comprising: a first fluid circuit for one of said motors including a high pressure supply line and also having a high fluid pressure motor line and a fluid return line, a pressure-limiting valve connected to said high fluid pressure motor line and said return line and having a valve member urged in a direction to block communication therebetween; a second fluid circuit for the other of said motors including a second high pressure supply line and also having a second high fluid pressure motor line and a second fluid return line, and a second pressure-limiting valve connected to said second high fluid pressure motor line and said second return line and having a valve member urged in a direction to block communication therebetween; each of said valve members being positionable in response to opposing forces generated by pressure in the high pressure supply line and the high fluid pressure motor line in the same fluid circuit acting in opposition to each other to control the communication of the high fluid pressure motor line with the fluid return line and blocking said communication when the pressure in the high fluid pressure motor line equals the pressure in the high pressure supply line, and means associated with each of the pressure-limiting valves to exert a force on the valve member responsive to pressure in the high pressure supply line of the other fluid circuit with the force acting in the same direction as said force generated by the pressure in the high fluid pressure motor line of the same circuit whereby the valve member is shifted to open said communication until the pressure in the high fluid pressure motor line of the same circuit is reduced to a value which achieves a balance in the forces opposing the force generated by the pressure in the high pressure supply line of the same circuit.

* * * * *